US008256618B2

(12) United States Patent
Schein et al.

(10) Patent No.: US 8,256,618 B2
(45) **Date of Patent: *Sep. 4, 2012**

(54) MAGNETIC STORAGE DEVICE AND A METHOD OF ASSEMBLING THE DEVICE

(75) Inventors: Thomas P. Schein, Appleton, WI (US); Brent J. Grinwald, Appleton, WI (US)

(73) Assignee: All About Packaging, Inc., Appleton, WI (US)

( * ) Notice: Subject to any disclaimer, the term of this patent is extended or adjusted under 35 U.S.C. 154(b) by 15 days.

This patent is subject to a terminal disclaimer.

(21) Appl. No.: 12/930,324

(22) Filed: Jan. 3, 2011

(65) Prior Publication Data

US 2012/0037537 A1 Feb. 16, 2012

Related U.S. Application Data

(60) Provisional application No. 61/401,402, filed on Aug. 11, 2010.

(51) Int. Cl.
*B65D 69/00* (2006.01)

(52) U.S. Cl. ..... 206/576; 206/705; 206/779; 206/372; 206/818

(58) Field of Classification Search ..... 206/703, 206/705, 818, 461, 462, 463, 464, 465, 467, 206/468, 470, 471, 564, 565, 566, 576, 779, 206/372; 220/784, 787

See application file for complete search history.

(56) References Cited

U.S. PATENT DOCUMENTS

| | | | | |
|---|---|---|---|---|
| 2,893,564 A | | 7/1959 | Gearhart | |
| 2,995,269 A | * | 8/1961 | Pease | 220/787 |
| 3,059,767 A | | 10/1962 | Chalfin | |
| 3,197,915 A | | 8/1965 | Stayer | |

(Continued)

FOREIGN PATENT DOCUMENTS

WO 03040659 5/2003

OTHER PUBLICATIONS

Nextag, Mechanics Time Saver (MTS728) ¼in. Drive Magnetic Black Socket Holder 4-14mm, website, www.nextag.com/Machanics-Time-Saver-MTS728-556441807/prices-html, printed Feb. 25, 2009, 1 page.

(Continued)

*Primary Examiner* — Jacob K Ackun
*Assistant Examiner* — Jenine Pagan
(74) *Attorney, Agent, or Firm* — Thomas J. Connelly; Wilhelm Law, S.C.

(57) ABSTRACT

A magnetic storage device is disclosed which is capable of retaining a plurality of articles, each having a thickness and a magnetic affinity. The storage device includes a base having a cavity which houses a magnetic member and a tray which mates with the base to enclose the magnetic member. The tray has a plurality of cavities formed in an upper surface and each of the cavities is designed to retain one of the articles. Each of the cavities has an elongated, semi-circular configuration with opposite ends located adjacent to a pair of raised abutments. The pair of raised abutments extends to a height less than the thickness of each article. The storage device also includes a cover which can be secured to the tray to enclose the plurality of articles therein. A method of assembling the magnetic storage device is also disclosed.

14 Claims, 4 Drawing Sheets

U.S. PATENT DOCUMENTS

| | | | | | |
|---|---|---|---|---|---|
| 3,248,167 | A | | 4/1966 | Friedman | |
| 3,405,377 | A | | 10/1968 | Pierce | |
| 3,500,364 | A | | 3/1970 | David et al. | |
| 3,598,900 | A | | 8/1971 | Drake | |
| 3,654,047 | A | | 4/1972 | Berkowitz | |
| 4,043,453 | A | | 8/1977 | Greenlee | |
| 4,096,581 | A | | 6/1978 | Carlo et al. | |
| 4,306,862 | A | | 12/1981 | Knox | |
| 4,353,465 | A | | 10/1982 | Rado | |
| 4,421,230 | A | | 12/1983 | Stanton | |
| 4,482,049 | A | | 11/1984 | Kot, II | |
| 4,844,263 | A | | 7/1989 | Hadtke | |
| 5,025,966 | A | | 6/1991 | Potter | |
| 5,056,661 | A | | 10/1991 | Balzano | |
| 5,080,230 | A | | 1/1992 | Winnard | |
| 5,195,538 | A | | 3/1993 | Eldridge, Jr. et al. | |
| 5,295,742 | A | * | 3/1994 | Knutson | 312/244 |
| 5,301,822 | A | | 4/1994 | Coleman et al. | |
| 5,344,012 | A | | 9/1994 | Matthews | |
| 5,460,305 | A | | 10/1995 | Ahearn | |
| 5,500,631 | A | | 3/1996 | Negus | |
| 5,526,927 | A | | 6/1996 | McLemore | |
| 5,560,480 | A | | 10/1996 | Singleton | |
| 5,586,657 | A | * | 12/1996 | Ward et al. | 206/705 |
| 5,660,276 | A | | 8/1997 | Winnard | |
| 5,669,516 | A | | 9/1997 | Horn | |
| 5,743,394 | A | | 4/1998 | Martin | |
| 5,871,100 | A | * | 2/1999 | Ward | 206/705 |
| 6,047,824 | A | | 4/2000 | Winnard | |
| 6,193,577 | B1 | | 2/2001 | Kaplan | |
| 6,443,305 | B1 | | 9/2002 | Stanford et al. | |
| 6,571,669 | B2 | | 6/2003 | Benatz et al. | |
| 7,032,711 | B1 | * | 4/2006 | Katz et al. | 182/129 |
| 7,757,867 | B2 | * | 7/2010 | Hsieh | 211/70.6 |
| 2002/0074254 | A1 | * | 6/2002 | Huang | 206/373 |
| 2007/0017837 | A1 | * | 1/2007 | McCambridge et al. | 206/373 |
| 2007/0074985 | A1 | | 4/2007 | Evans | |
| 2009/0020447 | A1 | * | 1/2009 | Potterfield et al. | 206/373 |

OTHER PUBLICATIONS

Snap-On Tools, Magnetic Socket Trays, website, www.buy1.snapon.com/catalog/tools.asp?tool=storage&Group_ID=3221 &store=snapon-st..., printed Feb. 25, 2009, 1 page.

Google, Image search for Magnetic Socket Tray, website, www.images.google.com/images?sourceid=navclient&rlz=1T4HPNW_enUS314US314&..., printed Feb. 25, 2009, 2 pages.

The Magnetic Blog, Magnets for Packaging Closures, website, www.everythingmagnetic.com/2009/01/magnets-for-packaging-closures/, printed Feb. 25, 2009, 2 pages.

All About Packaging Inc., No More Sliding or Hiding Tools!, Literature, Copyright 2009, 1 page.

* cited by examiner

MAGNETIC STORAGE DEVICE AND A METHOD OF ASSEMBLING THE DEVICE

CROSS-REFERENCE TO RELATED APPLICATIONS

This application claims priority under 35 U.S.C. §120 to application Ser. No. 61/401,402, filed Aug. 11, 2010, which is incorporated herein by reference in its entirety.

FIELD OF THE INVENTION

This invention relates to a magnetic storage device capable of retaining a plurality of products each having a magnetic affinity. A method of assembling the magnetic storage device is also taught.

BACKGROUND OF THE INVENTION

Today, there are many different types of magnetic storage devices that are used to hold a plurality of products. Some such storage devices include a magnetic strip or a plurality of spaced apart magnetic discs used to attach the storage device to a magnetically attractive surface. Examples of such devices are taught in U.S. Pat. No. 5,460,305 issued to Ahearn, and U.S. Pat. No. 5,056,661 issued to Balzano. The magnetically attractive surface can be a metal wall, a ferrous surface of a motor vehicle, a metal cabinet, a metal tool box, the metal part of a work bench, etc. Such storage devices usually have a plurality of indentations, cavities, pockets, openings, clips, sleeves, etc. into which one or more individual products can be inserted. The products can vary in type, kind and design. The products can include tools including but not limited to: different size wrenches, screwdrivers, various size socket heads which can be sequentially attached to a socket wrench, drills, drill bits, Allen wrenches, any tool having a stem or a shank, etc. The products can also include sporting goods, such as fishing lures, fishing hooks, fly fishing lures and hunting accessories. The products can further include medical implements, surgical tools, dental tools, small parts, etc. The total number of products capable of being held in such storage devices can vary from a few items to many items.

Other storage devices are also known which utilize one or more magnets to temporarily hold a plurality of products, each constructed from a ferrous metal and having a magnetic affinity, to the storage device. In these storage devices, one or more magnetic strips or discs are incorporated into the storage device such that they are exposed and can exert a magnetic attraction for the plurality of products inserted or placed therein. Examples of some such devices are taught in U.S. Pat. No. 2,893,564 issued to Gearhart; U.S. Pat. No. 5,025,966 issued to Potter; U.S. Pat. No. 5,080,230 issued to Winnard, and in U.S. Patent Publication 2007/0074985 to Evans.

Furthermore, there even exists some storage devices that use one or more magnetic members to temporality hold a plurality of products in place while using the same or different magnetic members to attach the storage device to a magnetically attractive surface. Examples of some of these kinds of devices are taught in U.S. Pat. No. 3,405,377 issued to Pierce; U.S. Pat. No. 5,301,822 issued to Coleman et al.; U.S. Pat. No. 5,500,631 issued to Negus; U.S. Pat. No. 5,669,516 issued to Horn and U.S. Pat. No. 5,743,394 issued to Martin.

It is well known that some manufacturers sell a plurality of products, each of which has a magnetic affinity, in a single package. Batteries are a common example wherein 1, 2, 3, 4, 5, 6, 7, 8, 9, 10, 11, 12, 13, 14, 15, 16, 18, 20 or more batteries are retained in a single package. The batteries can be identical or different in size, diameter, shape, etc. In addition, a plurality of identical, similar or different types of products, some of which may vary in shape can also be retained in a single package. For example, a package of screws, hooks, nuts, bolts, washers, roll pins, dowel pins, pins, nails, or a combination thereof, can be retained in a single package. Also, various metal products and/or parts, including ball bearings, clips, snaps, connectors, pins, hinges, etc. can be retained in a single package. Furthermore, some sets of tools, such as a set of different size wrenches, screw drivers, pliers, sockets, drills, drill bits, etc. are sold in a single package. By including a magnetic member in the package, one can retain and arrange a plurality of products and/or parts in a desired orientation.

In certain situations, it is advantageous to display such products and/or parts, each of which has a magnetic affinity, in a conspicuous manner. For example, by displaying identical size batteries in a transparent plastic package, a consumer can readily ascertain what size he or she needs and select the proper package. In addition, the plurality of batteries retained in a single package can be positioned such that the name of the manufacturer as well as the size of each battery can be visually noticeable. This will assist a consumer in purchasing the correct size batteries that are needed without having to manipulate the package or having to open the package. By including a magnetic member in the package, one can accomplish this. The magnetic member can also be used to retain the package in any desired orientation, even when the package is inverted.

Another desired feature is that some manufacturers would like the packages to also serve as a storage device for the plurality of products contained therein. For example, when a person purchases a package of identical size batteries, it is highly unlikely that all of the batteries will be used at once. Many times, only one or two of the batteries will be used immediately. The remaining batteries will be left in the opened package so that they can be used in the future. Many manufacturers are requiring that the original package can also serve as a storage device wherein the remaining products can be easily identified and be retrieved by the consumer. By including a magnetic member in the package, this can be accomplished.

Lastly, some consumers are asking that manufacturers package their products in packages that can be attached, nested, connected or be interlocked to another package so that two or more packages can be retained in a specific location. For example, a parent may want to keep a package of triple A size batteries together with a package of double A size batteries in a single location, say on the outside of the refrigerator door. When the kids need a battery, they can simply go over to the refrigerator door and retrieve the proper size and number of batteries needed. This saves the parent time and effort in searching in a kitchen drawer for the right number and size of batteries.

Now a magnetic storage device has been invented which can accomplish all of the above mentioned desired features. In addition, a method of assembling a magnetic storage device has also been invented.

SUMMARY OF THE INVENTION

Briefly, this invention relates to a magnetic storage device which is capable of retaining a plurality of products each having a magnetic affinity. The magnetic storage device includes a base, a tray, a magnetic member and a cover. The base is attached to the tray and serves to secure the magnetic member therebetween. The tray is configured to support a plurality of products each having a magnetic affinity. The plurality of products can be displayed in any desired manner for easy identification and purchase. The cover is removeably attached to either the base and/or the tray. The cover serves to retain the products in the tray such that the products cannot be removed from the magnetic storage device until the cover is opened.

The base, tray and/or the cover can be shaped and configured to enable a magnetic storage device to be attached, connected, nested or interlocked to one or more magnetic storage devices. This allows a consumer to group and retain several magnetic storage devices together or in close proximity to one another. By doing so, one can easily and readily retrieve the proper number and size of products needed in an efficient manner.

A method of assembling the magnetic storage device is also taught. The method includes the steps of forming a base, a tray, a removable cover and a magnetic member. The base and the tray are assembled with the magnetic member positioned therebetween. The magnetic member can be secured to either the base or the tray prior to assembly of the base to the tray. A plurality of products, each having a magnetic affinity, can then be positioned in the tray. The magnetic member will cause the plurality of products to acquire or retain a predetermined orientation. The removable cover is then secured to the base and/or to the tray. The method also includes opening the cover and removing one or more of the plurality of products from the tray and then closing the cover so that the magnetic device acts as a storage unit.

The general object of this invention is to provide a magnetic storage device capable of retaining a plurality of products each having a magnetic affinity. A more specific object of this invention is to provide a method of forming the magnetic member.

Another object of this invention is to provide a magnetic storage device which can retain a plurality of products while mounted in any orientation, even when inverted.

A further object of this invention is to provide a magnetic storage device that can hold a plurality of products and also serve as a storage device for the unused products.

Still another object of this invention is to provide a magnetic storage device which can retain a set of identical or different size products, each having a magnetic affinity, such as batteries.

Still further, an object of this invention is to provide a magnetic storage device that can be easily and economically manufactured.

Other objects and advantages of the present invention will become more apparent to those skilled in the art in view of the following description and the accompanying drawings.

DETAILED DESCRIPTION OF THE INVENTION

Figure 1:
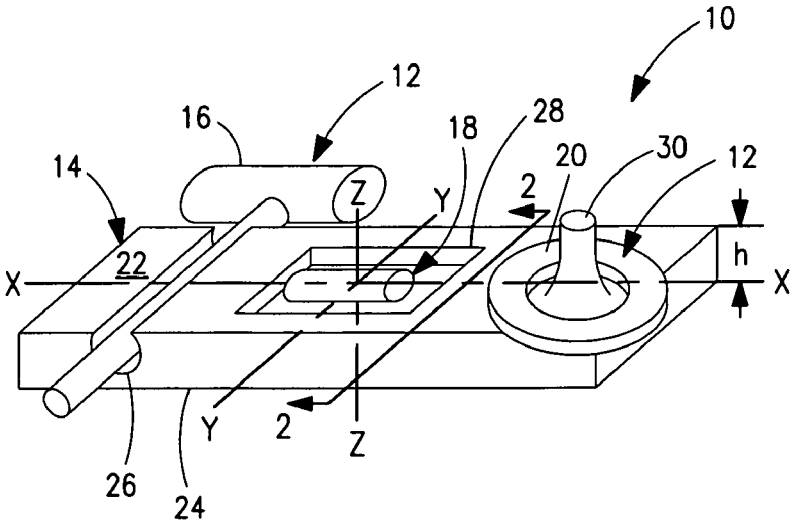
FIG. 1 is a perspective view of a magnetic storage device capable of retaining a plurality of products each having a magnetic affinity.

Referring to FIG. 1, a magnetic storage device 10 is shown which is capable of retaining at least one article 12, and desirably a plurality of articles 12, each having a thickness and a magnetic affinity. By "article" it is meant an individual thing or element of a class; a particular item. For example, the article 12 could be a tool, including but not limited to, a wrench, a socket, a socket head which can be connected to a socket wrench, a drill, a drill bit, a screwdriver, a screwdriver bit, a pair of pliers, a tool having a stem, shank or handle, or any other kind of tool. In addition, the article 12 could be a kitchen utensil, a battery, a key, a medal, a small part, a sporting goods such as hunting and fishing accessories, a bullet, a shotgun shell, a fishing lure, a fishing hook, a fishing fly, etc. The article 12 could also be an item needed for a particular hobby; an item associated with a particular activity or interest; an item needed to perform one's professional job, such as medical or dental instruments; an item needed to make or repair equipment such as jewelry components; a figurine such as toy metal soldiers; tie clips; bow ties or any item that includes a metal or iron part, or contain a metal coating. Furthermore, the article 12 could be any of various hardware items such as: a metal fastener, a metal stud, a cylindrical metal bar, a washer, a nut, a bolt, a screw, a pin, a nail, etc. Those skilled in the art will be aware that the article 12 can be almost any item created by man.

The magnetic storage device 10 includes a three-dimensional (3D) tray 14 with a longitudinal central axis X-X, a transverse central axis Y-Y and a vertical central axis Z-Z. The tray 14 is capable of holding or retaining one or more of the articles 12. Desirably, the tray 14 can retain a plurality of articles 12. Each of the articles 12 can be identical, similar or different in size, shape, type, kind and/or construction. In FIG. 1, three articles 12 are depicted, each of which varies in size, shape and kind. The left most article 12 is a hammer 16; the central article 12 is a cylindrical pin 18; and the right most article 12 is a washer 20.

Typically, one or more articles 12 will be packaged in the magnetic storage device 10. Desirably, two or more articles 12 will be packaged in the magnetic storage device 10. Even more desirably, several articles 12 will be packaged in the magnetic storage device 10. Most desirably, a plurality of articles 12 will be packaged in the magnetic storage device 10. The actual number of articles 12 retained, housed or stored in the magnetic storage device 12 can vary from one article to many articles. In some instances, the magnetic storage device 10 can hold a dozen or more articles 12, and in some instances, the magnetic storage device 10 can hold over a hundred small articles 12 depending upon the size and configuration of the particular articles 12.

The articles 12 can be formed, molded, manufactured, assembled and/or constructed such that at least a portion of each article 12 is formed from or contains a metal, such as iron or a metal oxide. Each article 12 could also contain a ferric or ferrous substance, include ferrous oxide or some other metal oxide, or be ferromagnetic. By "ferric" it is meant of or relating to, or containing iron, especially with a valence of 3 or a valence higher than in a corresponding ferrous compound. By "ferrous" it is meant of or relating to, or containing iron, especially with a valence of 2 or a valence lower than in a corresponding ferric compound. Alternatively, a portion of the outer periphery of an article 12 can contain a metal coating. Still further, a metal chip could be partially or fully inserted into each article 12 so that it has an affinity to a magnet.

Each article 12 has a magnetic affinity. By "magnetic affinity" it is meant the article 12 has a natural attraction to a magnet or magnetic member or magnetic substance. Each of the articles 12 can have a magnetically attractive portion or surface. Desirably, each of the articles 12 is constructed partially or totally out of metal or steel, or includes a metal chip, or contains a metal coating. The amount of metal from which each of the articles 12 is formed, or the amount of metal inserted into each of the articles 12, or the amount of metal coated onto each of the articles 12 can vary. Desirably, each article 12 has a metal content that is equal to at least about 5% of the article's total weight. When a metal coating is utilized which is sprayed, brushed, coated or somehow adhered to at least a portion of the outer periphery of the article 12, the actual amount of metal present can be even less than about 5% of the article's total weight. For example, the metal coating may constitute only about 3% of the article's total weight. Desirably, the amount of metal contained in each of the articles 12 or the amount of metal coating adhered to each of the articles 12 will range from between about 3% to about 100% of the article's total weight. More desirably, the amount of metal contained in each of the articles 12 or the amount of metal coating adhered to the articles will range from between about 5% to about 100%. Even more desirably, the amount of metal contained in of each of the articles 12 or the amount of metal coating adhered to the articles will range from between about 10% to about 100%.

When the article 12 is a tool, such as a wrench, the article 12 can contain from about 25% to about 100% metal. Desirably, when the article 12 is a tool, the article 12 can contain from about 50% to about 100% metal. More desirably, when the article 12 is a tool, the article 12 can contain from about 75% to about 100% metal.

Still referring to FIG. 1, the tray 14 can be formed using various processes known to those skilled in the art. Injection molding and thermoforming are two common methods that can be employed to construct the magnetic storage device 10. The magnetic storage device 10 can be constructed from one or more materials. Such material(s) include but are not limited to: a plastic such as a polyolefin, polyethylene, polypropylene or a combination thereof; a thermoplastic; a clear plastic; a transparent plastic; a colored plastic; stamped sheet metal; a metal or a metal alloy; aluminum or an aluminum alloy; wood; glass; fiberglass; plywood; paper; paperboard; cardboard; veneer; a composite material; a fabric; a leather; etc. Desirably, a portion of the magnetic storage device 10 is constructed from a clear or transparent material, such as plastic, so that the article 12 retained therein is visible to the naked eye.

Alternatively, the magnetic storage device 10 could be made from a single material embedded with a permanent magnet or a permanent magnetic powder. The material would likely be considered a binder, such as an epoxy. The combination of magnetic material and binder could be molded, machined or die-pressed into a desired shape.

Still referring to FIG. 1, the tray 14 has an upper surface 22, a lower surface 24 and a height h therebetween. The overall geometrical configuration of the tray 14 can vary. Likewise, the height h can vary in dimension. Desirably, the height h of the tray 14 is at least about 0.25 inches. More desirably, the height h of the tray 14 is at least about 0.5 inches. Even more desirably, the height h of the tray 14 is at least about 0.75 inches. The tray 14 can have a height h that ranges from between about 0.25 inches to about 12 inches. Desirably, the tray 14 has a height h which ranges from between about 0.3 inches to about 3 inches. Even more desirably, the tray 14 has a height h which ranges from between about 0.4 inches to about 2 inches.

The upper surface 22 of the tray 14 can be flat, planar, curved or arcuate, or be irregular in profile. The upper surface 22 can be completely flat or have one or more indentations, cavities, depressions, channels, etc. extending downward therefrom. The upper surface 22 can also have one or more humps, bumps, protrusions, extensions, etc. extending upward therefrom. The one or more indentations, cavities, depressions, channels, etc. and/or the one or more humps, bumps, protrusions, extensions, etc. can function to influence the position, alignment and/or spatial orientation of each of the articles 12 on the tray 14. The primary functions of the indentations, cavities, depressions, channels, humps, bumps, protrusions and extensions is to limit the movement of each of the articles 12 and to orient or establish the position of each of the articles 12 on the tray 14. The indentations, cavities, depressions, channels, humps, protrusions and extensions limit the movement of the articles 12 in one or more directions. The articles 12 can be positioned and retained in a set orientation relative to the X-X, Y-Y and Z-Z axes.

The articles 12 can be spaced away from the lower surface 24 by any desired distance. Any single indentation, cavity, depression, channel, hump, bump, protrusion or extension can be designed to influence the position and specific orientation of one or more of the articles 12 such that their magnetic affinity is aligned in a predetermined direction. Likewise, multiple indentations, cavities, depressions, channels, humps, bumps, protrusions or extensions can be designed to influence the position and specific orientation of a single article 12.

The one or more indentations, cavities, depressions, channels, etc. and/or the one or more humps, bumps, protrusions, extensions, etc. can also immobilize each of the articles 12 in an orderly and organized manner. In FIG. 1, a semi-circular, elongated channel 26 is depicted formed in the upper surface 22 into which the handle of the hammer 16 is retained. The upper surface 22 also has a rectangularly shaped cavity 28 for retaining the cylindrical pin 18, and a conical protrusion 30 for retaining the washer 20. The outer perimeter of the upper surface 22 can be of any desired geometrical shape.

The lower surface 24 of the tray 14 is relatively flat or planar although it could be somewhat irregular, if desired. The lower surface 24 can also be slightly concave or convex. The lower surface 24 could also be textured, if desired. Desirably, the lower surface 24 is relatively flat so that it can rest against another flat surface. The outer perimeter of the lower surface 24 can be of any desired geometrical shape. The outer perimeter of the lower surface 24 can be identical, similar or different in size and/or shape from the outer periphery of the upper surface 22. The lower surface 24 is designed to contact and be magnetically attracted to a metal member. The metal member can be a stationary or movable member. The metal member should be at least partially constructed from a ferric or ferrous substance, such as a metal or steel, and have a magnetic affinity. The metal member can be any one of various items including but not limited to: a metal storage cabinet; a steel cabinet, a metal appliance, such as a door or a side of a refrigerator; a tool box; a wheeled tool cart; a tool chest; a sliding drawer constructed from metal; a vehicle fender, outer body or bumper, such as the outer surface of a car, truck, van, bus, motorcycle, etc.; a metal post; a metal beam; etc.

Figure 2:
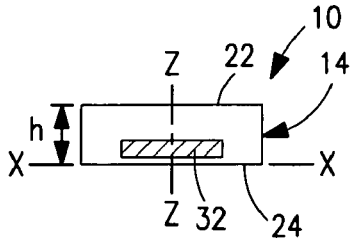
FIG. 2 is a cross-sectional view of the magnetic storage device shown in FIG. 1 taken along line 2-2.

Referring now to FIG. 2, the magnetic storage device 10 also includes a magnetic member 32. The magnetic member 32 can include one or more permanent magnets. The magnetic member 32 is also a 3-dimensional (3-D) member that can vary in size, shape, type and kind. The magnetic member 32 can be a single magnet or a series of magnet segments. In FIG. 2, the magnetic member 32 is shown as a single, elongated magnet having a rectangular cross-sectional configuration. The magnetic member 32 is completely enclosed and embedded in the tray 14 and is positioned or aligned closer to the lower surface 24 than to the upper surface 22. However, the magnetic member 32 could be spaced an equal distance from the upper and lower surfaces, 22 and 24 respectively, or be positioned closer to the upper surface 22, if desired. Desirably, the magnetic member 32 is located closer to the lower surface 24 so that it exerts a sufficient magnetic affinity for attaching the magnetic storage device 10 to a metal member (not shown) when it is brought into close contact with the metal member. By attaching the lower surface 24 of the tray 14 to the metal member, the upper surface 22 and the articles 12 positioned thereon or therein will be readily accessible.

The magnetic member 32 can be fully enclosed in the tray 14 by forming the tray 14 from two or more sections. There are a variety of possible embodiments where two or more sections are used to enclose or surround the magnetic member 32. One way to visualize these embodiments is to picture a shell surrounding the magnetic member 32. The shell can be divided many different ways. For example, the shell can be divided into top and bottom members, left and right members, major and minor members, etc. The two or more sections can be assembled around the magnetic member 32 and fastened to one another in a variety of ways, including but not limited to: using a press fit, a snap fit, using molded-in-threads (helix threads), fasteners such as screws, pins, rivets, using solvent bonding, adhesive bonding, ultrasonic welding, vibration welding, spin welding, electromagnetic welding, induction welding, hot platen or hot plate welding, staking, brazing, soldering, crimping, sewing, etc.

Figure 3:
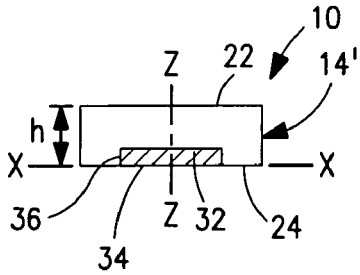
FIG. 3 is a cross-sectional view of an alternative embodiment of the magnetic storage device shown in FIG. 1.

Referring now to FIG. 3, an alternative embodiment of a magnetic storage device 10' is depicted. In the magnetic storage device 10', the magnetic member 32 is aligned flush with the lower surface 24 of the tray 14' and exhibits an exposed surface 34. In other words, the magnetic member 32 is not completely embedded in the tray 14'. In this embodiment, the exposed surface 34 of the magnetic member 32 can be aligned flush with the lower surface 24, be slightly raised above the lower surface 24, or extend slightly below the lower surface 24. Desirably, the exposed surface 34 of the magnetic member 32 is aligned flush with the lower surface 24 of the tray 14'. This configuration will allow the lower surface 24 of the tray 14' to be attached flush with a metal member, such as the fender on an automobile (not shown). There are various ways of fastening the magnetic member 32 to the tray 14'. For example, a recess 36 can be formed in the lower surface 24 of the tray 14'. The magnetic member 32 can be inserted or be positioned in the recess 36. Various mechanical fasteners or an adhesive can be used to secure the magnetic member 32 in the recess 36. For example, one could use a press fit, a snap fit, use an over molding technique, mold-in-threads (helix threads), use screws, pins, rivets, etc., use solvent bonding, adhesive bonding, ultrasonic welding, vibration welding, spin welding, electromagnetic welding, induction welding, hot platen or hot plate welding, staking, brazing, soldering, crimping, sewing or other means known to those skilled in the art.

Alternatively, the lower surface 24 of the tray 14' can contain a recess 36 which surrounds the magnetic member 32 and a base (not shown) can be secured to the tray 14' so as to enclose the recess 36.

Figure 4:
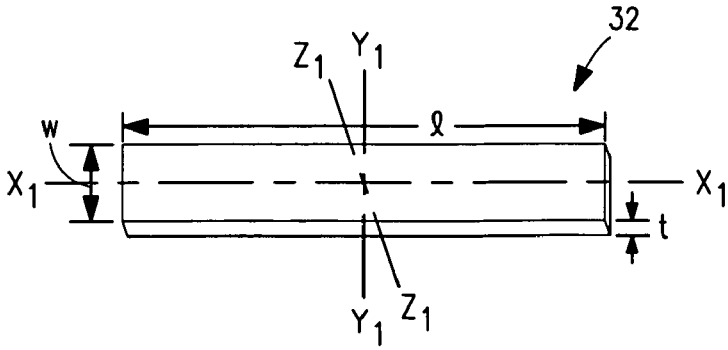
FIG. 4 is a perspective view of an elongated magnet having a rectangular cross-section.

Turning now to FIG. 4, one example of a magnetic member 32 is depicted. The magnetic member 32 can be a flexible magnet or a non-flexible magnet. The magnetic member 32 can have any desired geometrical configuration but for explanation purposes only, it will be described as an elongated strip of magnetic material having a longitudinal central axis $X_1$-$X_1$, a transverse central axis $Y_1$-$Y_1$, and a vertical central axis $Z_1$-$Z_1$. The magnetic member 32 has a length l measured parallel to the longitudinal central axis $X_1$-$X_1$. The length l of the magnetic member 32 can vary. When the magnetic member 32 is a single elongated strip, it should have a length l of at least about 1 inch, desirably, at least about 2 inches, and more desirably, at least about 3 inches. The length l of the magnetic member 32 can vary depending upon the size of the magnetic storage device 10 or 10' that it is associated with. Normally, the length l of the magnetic member 32 will increase as the overall length of the magnetic storage device 10 or 10' increases.

The magnetic member 32 also has a width w which can also vary. The width w of the magnetic member 32 can range from between about 0.1 inches to about 2 inches. Desirably, the width w of the magnetic member 32 ranges from between about 0.2 inches to about 1.5 inches. More desirably, the width w of the magnetic member 32 ranges from between about 0.3 inches to about 1.25 inches. Furthermore, the magnetic member 32 has a thickness t which can vary as well. The thickness t of the magnetic member 32 can range from between about 0.01 inches to about 0.5 inches. Desirably, the thickness t of the magnetic member 32 ranges from between about 0.05 inches to about 0.3 inches. More desirably, the thickness t of the magnetic member 32 ranges from between about 0.1 inches to about 0.25 inches.

The magnetic member 32 can be purchased from a variety of commercial vendors. One such company that sells magnets is Bunting Magnetic Company of Newton, Kans. The magnetic member 32 can be formed from any suitable magnet material, including ceramic, metallic and flexible magnetic materials. The magnetic member 32 can be a discrete ceramic or ferrite elements in a discoidal or substantially rectangular shape. Alternatively, the magnetic member 32 can be cut from a magnetic sheet into a smaller shape and size. Multiple smaller magnetic members can be cut to form a series of discrete magnets.

The magnetic member 32 can also be formed from a homogeneous material which is magnetized with one pole along one surface and an opposite pole along an opposite surface to form north-south regions. Likewise, the magnetic member 32 can be formed from a conventional flexible magnet of the sort having magnetizable barium ferrite particles dispersed in a rubbery matrix. Such materials are available from Arnold Engineering Company and RJF International Corporation. The magnetic member 32 can further be formed from a suitable powdered metallic material such as iron oxide.

The magnetic member 32 can be held in place in any suitable manner. For example, the magnetic member 32 can be secured to the tray 14 or 14' by glue, an adhesive, by an epoxy, by a silicone adhesive, by a cyanoacrylate adhesive, or by some other adhesive known to those skilled in the adhesive art. Alternatively, the magnetic member 32 could be inserted into the recess 36 and be held in place by a tight, friction or interference fit. Still further, the magnetic member 32 could be secured to the tray 14 or 14' by a mechanical device or be secured using a tongue and groove structure.

The magnetic member 32 can produce a magnetic flux. The magnetic flux serves two purposes. First, the magnetic flux will attract and secure the lower surface 24 of the tray 14 or 14' to a metal member (not shown). The magnetic flux is of sufficient force that the magnetic storage device 10 or 10' will resist movement relative to the metal member. Second, the magnetic flux will hold each of the articles 12 in position adjacent to the upper surface 22 of the tray 14 or 14', or in one of the indentations, cavities, depressions, channels, or on one of the humps, bumps, protrusions or extensions. When the articles 12 are positioned or placed within one of the indentations, cavities, depressions, channels, or on one of the humps, bumps, protrusions, extensions, the user of the magnetic storage device 10 or 10' will have to exert a slight force in order to remove each of the articles 12 from its original position. The magnetic flux insures that vibration, bumping or jarring of the magnetic storage device 10 or 10' will not cause the articles 12 to dislodge from the respective indentations, cavities, depressions or channels, or from the humps, bumps, protrusions or extensions. The magnetic flux also assures that each of the articles 12 can be removed from the magnetic storage device 10 or 10' without disturbing the position of the magnetic storage device 10 or 10' relative to the metal member.

The magnetic flux is not so strong that it prevents or hinders a person, such as a mechanic, in removing and/or replacing an article 12 from and then back into the magnetic storage device 10 or 10'. Desirably, a person should be able to remove or replace an article 12 using only one hand. The magnetic storage device 10 or 10' facilitates the utilization of a set of tools, i.e. socket wrench heads, especially when the mechanic is in an awkward position such that a one-handed operation is essential. Likewise, the magnetic flux is not so strong that it prevents or hinders a person from removing the magnetic storage device 10 or 10' from the metal member.

The magnetic member 32 exerts a sufficient magnetic attraction on the articles 12 when each is positioned on the upper surface 22, or is placed in one of the indentations, cavities, depressions or channels, or is placed on one of the humps, bumps, protrusions or extensions. This magnetic attraction will temporarily retain the articles 12 therein. The magnetic member 32 exerts a sufficient magnetic attraction such that the articles 12 will be retained on the upper surface 22, or in one of the indentations, cavities, depressions or channels, or on one of the humps, bumps, protrusions or extensions even when the magnetic storage device 10 or 10' is placed at a steep angle, for example, at 90 degrees to the ground or floor, or is inverted (turned upside down).

As stated above, the magnetic member 32 also simultaneously exerts a sufficient magnetic flux or attraction through the lower surface 24 or through its exposed surface 34 to releasably attach the magnetic storage device 10 or 10' to a metal member. The magnetic member 32 will secure the magnetic storage device 10 or 10' to any ferrous metallic surface, such as a metallic work bench or shelf, a motor vehicle, or any other suitable location. For example, the magnetic storage device 10 or 10' can be used by a mechanic working in the engine compartment of a motor vehicle. The magnetic storage device 10 or 10' can be magnetically attached to any portion of the metal surface of the vehicle. The orientation of the magnetic storage device 10 or 10' is not important since it can be attached to a metal surface of the vehicle even while inverted or on its side. The placement of the magnetic storage device 10 or 10' close to the area being worked upon increases the efficiency of the mechanic and generally makes the job a lot easier.

There may also be times when a mechanic does not know the exact diameter of a particular socket wrench head which is needed to fit onto the head of a bolt, which is to be removed or tightened. In this situation, the mechanic will try to match up a socket wrench head to test the size of the bolt. The mechanic may have to try two or three socket wrench heads before he finds the correct diameter. Having the magnetic storage device 10 or 10' located adjacent to his work area will make this whole process quicker and more efficient. The mechanic will not be required to reach for another socket wrench head which may be located several feet away.

Figure 5:
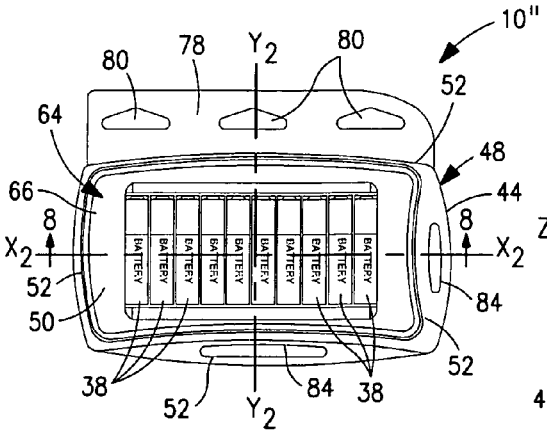
FIG. 5 is a front view of another embodiment of a magnetic storage device.
Figure 6:
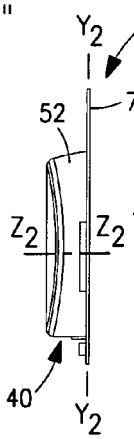
FIG. 6 is a right side view of the magnetic storage device shown in FIG. 5.
Figure 7:
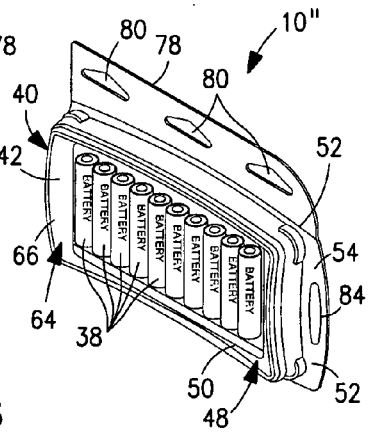
FIG. 7 is a perspective view of the magnetic storage device shown in FIG. 5.
Figure 8:
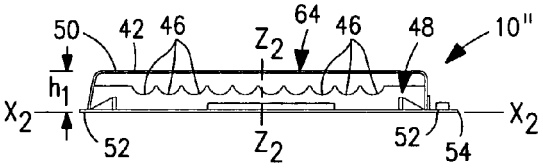
FIG. 8 is a cross-sectional view of the magnetic storage device taken along line 8-8 of FIG. 5.

Referring now to FIGS. 5-9, another embodiment of a magnetic storage device 10" is depicted. This magnetic storage device 10'" is specifically designed to house and retain a plurality of batteries 38. However, the magnetic storage device 10" could retain or house different articles 12 as well. The batteries 38 are depicted as all being of the same size. However, two or more different size batteries 38 could be retained or housed in the magnetic storage device 10'", if desired. The exact number of batteries 38 retained in the magnetic storage device 10" can vary from 1 to about 50 or more. In FIGS. 5-7, ten batteries 38 are shown and each is of the same size. The batteries 38 can vary in actual size. For example, the batteries can be AAA, AA, A, C, D, or any other size that is commercially manufactured.

The magnetic storage device 10" has a longitudinal central axis $X_2$-$X_2$, a transverse central axis $Y_2$-$Y_2$, and a vertical central axis $Z_2$-$Z_2$. The magnetic storage device 10" includes a three dimensional (3D) tray 40 having an upper surface 42, a lower surface 44 and a height $h_1$ therebetween. The tray 40 has one or more cavities 46 formed therein. Desirably, the tray 40 has two or more cavities 46 formed therein. More desirably, the tray 40 has a plurality of cavities 46 formed therein. Ten cavities are depicted in FIG. 5, with each cavity 46 being sized and configured to receive at least a portion of a battery 38. Each battery 38 has a thickness or diameter d, see FIG. 9. As mentioned above, the battery 38 could be any other article having a predetermined thickness. If the battery 38 does not have an elongated, cylindrical shape with a measurable diameter, then the thickness of the battery 38 can be used. For example, a smoke detector uses a rectangularly shaped battery having a thickness of about ⅜ of an inch.

The plurality of cavities 46 formed in the tray 40 can be of any desired geometrical shape. As depicted, each of the plurality of cavities 46 has an elongated, semi-circular configuration with opposite ends. Multiple cavities 46 form an undulating surface having a scallop appearance. The opposite ends of each of the plurality of cavities 46 can be at least partially surrounded by a pair of raised abutments 48, 48. The pair of raised abutments 48, 48 is shown being located at opposite ends of each of the semi-circular cavities 46. Alternatively, one could utilize a single raised abutment 48 which is located at one end of each of the semi-circular cavities 46.

The pair of raised abutments 48, 48 are spaced apart and aligned parallel to one another. Each of the pair of raised abutments 48, 48 is located adjacent to an end of each of the plurality of cavities 46. Each of the pair of raised abutments 48, 48 has an upper surface 50, 50. The upper surface 50 of each of the pair of raised abutments 48, 48 can vary in configuration. For example, the upper surface 50 can be planar, concave, convex, irregular, curved, etc. The upper surface 50 can also vary in height along its length. Desirably, the height of the upper surfaces 50, 50 will be constant throughout their lengths. The upper surface 50 of each of the pair of raised abutments 48, 48 is located below the upper surface 42 of the tray 40. The upper surface 50 of each of the pair of abutments 48, 48 is positioned above the lowest point of each of the plurality of cavities 46. The upper surface 50 of each of the pair of abutments 48, 48 extends upward to a height that is less than half of the thickness or diameter of one of the batteries 38 positioned in one of the plurality of cavities 46.

The upper surface 50 of each of the pair of abutments 48, 48 can have a height that intersects the thickness or diameter of each of the batteries 38 such that from about 1% to about 50% of the thickness or diameter of each battery 38 is at or below the upper surface 50. Another way of stating this is to say that less than about 50% of the thickness or diameter of each battery 38 is positioned in one of the plurality of cavities 46. Desirably, less than about 45% of the thickness or diameter of each battery 38 is positioned in one of the plurality of cavities 46. More desirably, less than about 40% of the thickness or diameter of each battery 38 is positioned in one of the plurality of cavities 46. Even more desirably, less than about 35% of the thickness or diameter of each battery 38 is positioned in one of the plurality of cavities 46. Most desirably, less than about 30% of the thickness or diameter of each battery 38 is positioned in one of the plurality of cavities 46. The reason for this size difference is to allow a person to easily retrieve a battery 38 from the tray 40. By limiting the height of the pair of abutments 48, 48, one can quickly and readily remove each of the batteries 38 from their respective cavities 46 or return a battery to a cavity 46.

The magnetic storage device 10" further includes a nesting, overlapping or locking feature which enables one magnetic storage device 10" to be positioned adjacent to or be conterminously aligned with another like magnetic storage device 10". This feature can be accomplished several ways. One way is to construct the tray 40 with a flange 52. The flange 52 terminates into an outer periphery 54. The flange 52 can extend horizontally outward to the outer periphery 54, see FIG. 8. The flange 52 can extend outward from a portion of the tray 40 or from the entire tray 40. In other words, the flange 52 can extend outward a full 360 degrees or only extend outward a portion thereof. In FIG. 5, the flange 52 extends outward beyond the entire upper surface 42 of the tray 40. The length or extent that the flange 52 extends outward from the outline of the upper surface 42 of the tray 40 can vary. Alternatively, the length or extent that the flange 52 extends outward from the outline of the upper surface 42 of the tray 40 can be a constant. In other words, the flange 52 would extend outward the same amount from all points of the outline of the upper surface 42 of the tray 40. In FIG. 5, the flange 52 extends outward from the right side and the bottom of the outline of the upper surface 42 of the tray 40 to a greater extent than it does on the left side. However, one can choose in what direction one wishes the flange 52 to extend outward from the outline of the upper surface 42 of the tray 40. The flange 52 can extend outward from the entire outline of the upper surface 42 of the tray 40 an equal amount. Likewise, one can manufacture the tray 40 such that the flange 52 extends outward different amounts from the various sides of the tray 40. The size, shape, and/or geometrical configuration of the flange 52 can also vary. Furthermore, the flange 52 can vary in thickness. The thickness of the flange 52 is measured parallel to the vertical central axis $Z_2$-$Z_2$.

The amount the flange 52 extends outward from the outer periphery 54 of the tray 40 can vary from between about 0.05 inches to about 1 inch or more. Desirably, the flange 52 extends outward from the outline of the upper surface 42 of the tray 40 from between about 0.1 inches to about 0.75 inches. The flange 52 can extend outward parallel to the longitudinal central axis X-X and/or parallel to the transverse central axis Y-Y.

Figure 9:
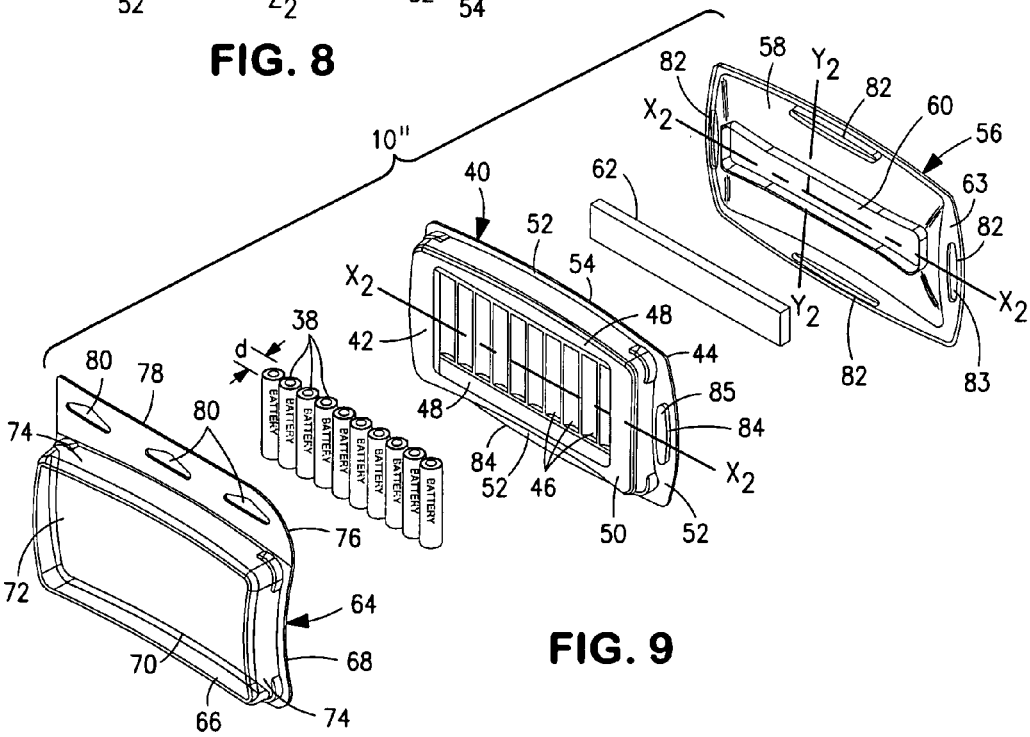
FIG. 9 is an exploded view of the magnetic storage device shown in FIG. 5.

Referring now to FIG. 9, the magnetic storage device 10" also includes a base 56 having an upper surface 58 and a cavity 60 formed in the upper surface 58. The upper surface 58 can be contoured, if desired. The upper surface 58 of the base 56 is sized and configured to mate or nest with the lower surface 44 of the tray 40. Alternatively, the base 56 can be sized and configured so that it can be adhesively bonded, mechanically attached, secured by an interference fit, a friction fit, or otherwise be secured to the tray 40 by means known to those skilled in the art.

The cavity 60 formed in the base 56 can vary in size; shape and location. Desirably, the cavity 60 is an elongated opening that extends downwardly from the upper surface 58 and has a longitudinal axis which is aligned parallel with the longitudinal axis $X_2$-$X_2$. The cavity 60 is designed to receive, partially or fully, a magnetic member 62. The magnetic member 62 can be similar to the magnetic member 32, explained above with reference to FIG. 4. The magnetic member 62 will be sandwiched between the tray 40 and the base 56 when these two members are secured together. The cavity 60 prevents the magnetic member 62 from appreciably moving in any direction a considerable amount. The magnetic member 62 exerts a sufficient magnetic attraction through the base 56 to releasably attach the magnetic storage device 10" to a magnetically attractive surface. The upper surface 58 of the base 56 can include a flange 63. The flange 63 can be sized and configured to match the flange 52 formed on the tray 40. The flange 63 should extend horizontally outward from the base 56.

The magnetic storage device 10" can further include a cover 64 which is sized and configured to fit over the tray 40 and can rest against the upper surface 58 of the base 56. The cover 64 can be constructed from a clear or transparent material, such as clear plastic, so that the articles 12 positioned on the tray 40 are visible to the naked eye. The cover 64 can be constructed so that it can be completely removed from the tray 40, as depicted in FIG. 9, or it can be secured to the tray 40 by one or more hinges (not shown). In either embodiment, the cover 64 should allow easy access to the batteries 38 housed on the tray 40.

The cover 64 has an upper surface 66 and a lower surface 68. The cover 64 also has a hollow cavity 70 which is open to the lower surface 68. The hollow cavity 70 is sized and configured to fit over the tray 40 and contact the flange 52. Desirably, the hollow cavity 70 is sized and configured to mate with at least a portion of the outer periphery 54 of the tray 40. The upper surface 66 of the cover 64 forms a plateau 72 having side walls 74. Four sidewalls 74, 74, 74 and 74 are present in FIG. 9 although only two of the side walls 74, 74 are visible in this view. It should be understood that if the cover 64 was formed with a circular configuration, than it would have one continuous sidewall 74. If the cover 64 was formed with a triangular configuration, than it would have three sidewalls 74, 74 and 74.

The four sidewalls 74, 74, 74 and 74 extend downward a desired amount and terminate at a flange 76. The flange 76 can vary in size and shape. The amount the flange 76 extends horizontally outward from one or more of the sidewalls 74, 74, 74 and 74 can also vary. Typically, the amount that the flange 76 can extend outward from at least one of the sidewalls 74, 74, 74 and 74 will range from between about 0.1 inches to about 6 inches or more. In the embodiment shown in FIGS. 5-7 and 9, the portion of the flange 76 extends upwards from the top edge of the plateau 72 and has a greater dimension than the portions which extend outward from the left, right and bottom edges of the cover 64. However, one can size and shape the flange 76 to any desired dimension and configuration.

In FIG. 9, the portion of the flange 76 that extends upwards from the top edge of the plateau 72 includes a printable surface 78. The printable surface 78 can be formed from paper, paper board, cardboard or some other material on which one can print or write. For example, the printable surface 78 can be an adhesive backed paper that is secured to a portion of the flange 76. The printable surface allows information and/or advertisements about the batteries 38 retained in the magnetic storage device 10" to be displayed. Such information can include but is not limited to: the price of the batteries 38, the name of the batteries 38, the manufacturer of the batteries, the size of the batteries 38, the life of the batteries 38, etc.

Referring to FIGS. 5, 7 and 9, one or more openings 80 can be formed in the flange 76. The openings 80 are spaced apart from one another and function as a means for supporting the magnetic storage device 10" on one or more horizontal hooks (not shown) normally found in a retail outlet. The horizontal hooks provide an efficient way to mount a plurality of the magnetic storage devices 10" adjacent to one another and in a compact fashion on vertical peg board at a retail store. Such an arrangement allows consumers to readily view the batteries 38 and remove one or more of the magnetic storage devices 10" when they are ready to purchase the packages.

Referring again to FIG. 9, the magnetic storage device 10" further includes a first attachment mechanism 82 formed on the flange 63 of the base 56. The first attachment mechanism 82 can vary in size, shape and configuration. The first attachment mechanism 82 is shown as a hollow protrusion which projects upward from the flange 63. The first attachment mechanism 82 has a closed top surface 83 and an open bottom surface (not visible in FIG. 9). Four of the first attachment mechanisms 82 are depicted with one aligned adjacent to the right side, left side, top side and bottom side of the base 56. It should be understood that one or more of the first attachment mechanisms 82 can be present on the base 56.

The magnetic storage device 10" also includes a second attachment mechanism 84 formed on the flange 52 of the tray 40. The second attachment mechanism 84 can vary in size, shape and configuration but has to be sized, shaped and configured to mate with one of the first attachment mechanisms 82. The second attachment mechanism 84 is shown as a hollow protrusion which projects upward from the flange 52. The second attachment mechanism 84 has a closed top surface 85 and an open bottom surface (not visible in FIG. 9). The upwardly extending protrusion of the first attachment mechanism 82 is sized and configured to mate or nest with the open bottom surface of the second attachment mechanism 84. Two of the second attachment mechanisms 84, 84 are shown in FIGS. 5 and 9. However, it should be understood that one or more of the second attachment mechanisms 84 can be present on the tray 40. Each of the second attachment mechanisms 84 is sized and shaped to mate or nest with one of the first attachment mechanisms 82, 82, 82 and 82. The interaction between the first and second attachment mechanisms, 82 and 84 respectively, function to secure the tray 40 to the base 56. Desirably, a friction fit is established between the connection of the first and second attachment mechanisms, 82 and 84 respectively.

Figure 10:
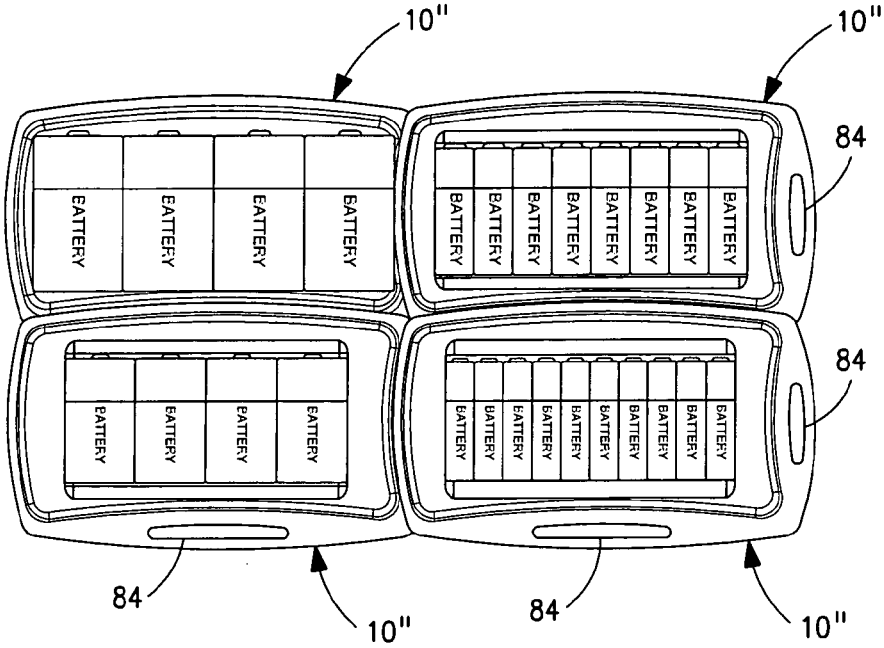
FIG. 10 is a perspective view of four magnetic storage devices connected together and with each device retaining batteries of a different size.

Referring now to FIG. 10, each of the second attachment mechanisms 84, 84 serve two functions. First, when the first and second attachment is mechanisms, 82 and 84 respectively, are mated or nested together, they provide a means for securing the tray 40 to the base 56. This connection can result in a friction fit, an interlocking fit, an interference fit, etc. The mating of the first and second attachment mechanisms, 82 and 84 respectively, should form a secure fit such that the tray 40 and the base 56 will not easily separate from one another. The second function served by each of the second attachment mechanisms 84 is that each provides a means for attaching or securing a second magnetic storage device 10" to the magnetic storage device 10".

Still referring to FIG. 10, four magnetic storage devices 10" are shown which are assembled together. Each of the second attachment mechanisms 84 provides a way to secure one magnetic storage devices 10" to another magnetic storage device 10". Sometimes, it is desirable to group two or more of the magnetic storage devices 10" together. If a magnetic storage device 10" contains AAA size batteries 38, and a second magnetic storage device 10" contains AA size batteries 38, and a third magnetic storage device 10" contains A size batteries 38, then a consumer can group all three magnetic storage devices 10", 10" and 10" together. When the consumer is in need of a particular size battery 38, he or she can go to one location to retrieve the correct size battery 38. The ability to mesh, overlap or connect two or more of the magnetic storage devices 10", 10" enhances the ability of a manufacturer to get a consumer to purchase more than one package of their products. This can produce increased sales which will hopefully lead to increased profits.

Although one specific way to connect or mesh two or more magnetic storage devices 10", 10" has been described above using the second attachment mechanisms 84, one skilled in the art will understand that a variety of ways exist to connect or interlock two or more of the magnetic storage devices 10", 10" together. For example, one can fit, mesh or connect two or more of the magnetic storage devices 10", 10" together using mechanical connections. Two or more of the magnetic storage devices 10", 10" can be mated together by using press fits, such as a plug engaging a hollow socket; a snap fit; an interference fit, such as a ball and socket arrangement; an overlapping mechanism, such as a pintle and hook, a plug and yoke; as well as intermeshing mechanisms, such as puzzle piece connections, male and female threads, etc. Furthermore, one can insert or position a magnet in the tray 40 or base 56 portions of a magnetic storage device 10" such that it will magnetically be attracted to another magnetic storage device 10". Those skilled in the fastening or mating art will be aware of still other ways to provide an association between two or more of the magnetic storage devices 10", 10".

Figure 11:
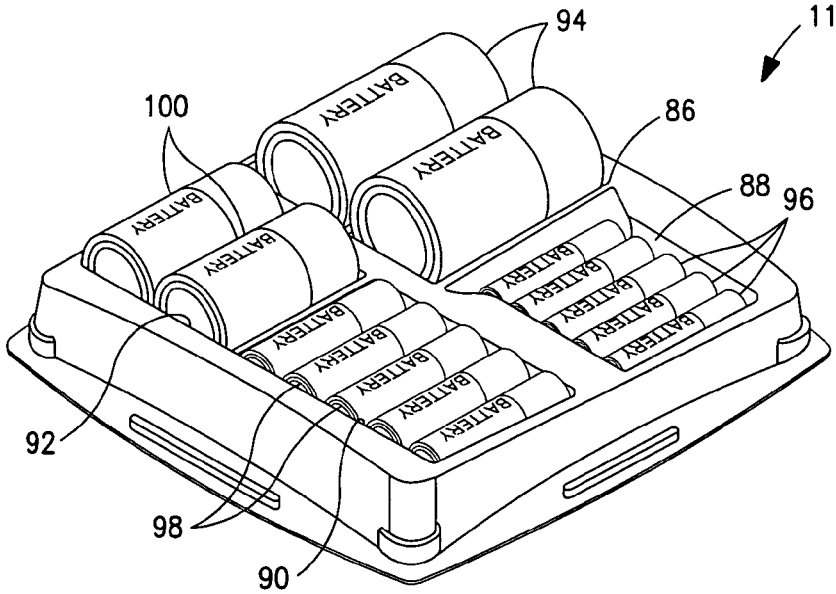
FIG. 11 is a perspective view of still another embodiment of a magnetic storage device which is capable of retaining a plurality of different size articles.

Referring now to FIG. 11, a magnetic storage device 11 is shown which is capable of retaining different size articles 12. The articles 12 are depicted as four different size batteries. The magnetic storage device 11 contains two or more cavities 86, 88, 90 and 92 of four different sizes. In this embodiment, there are two of the cavities 86, 86 which are sized and shaped to hold two D size batteries 94; there are five of the cavities 88, 88, 88, 88 and 88 which are sized and shaped to hold five AAA size batteries 96, 96, 96, 96 and 96; there are five cavities 90, 90, 90, 90 and 90 which are sized and shaped to hold five AA size batteries 98, 98,98,98 and 98; and two of the cavities 92, 92 which are sized and shaped to hold two C size batteries 100, 100. It should be understood that the number, size and shape of the cavities 86, 88, 90 and 92 can vary to accommodate the number, size and shape of the articles 12 one wished to retain in the magnetic storage device 11.

METHOD

Figure 12:
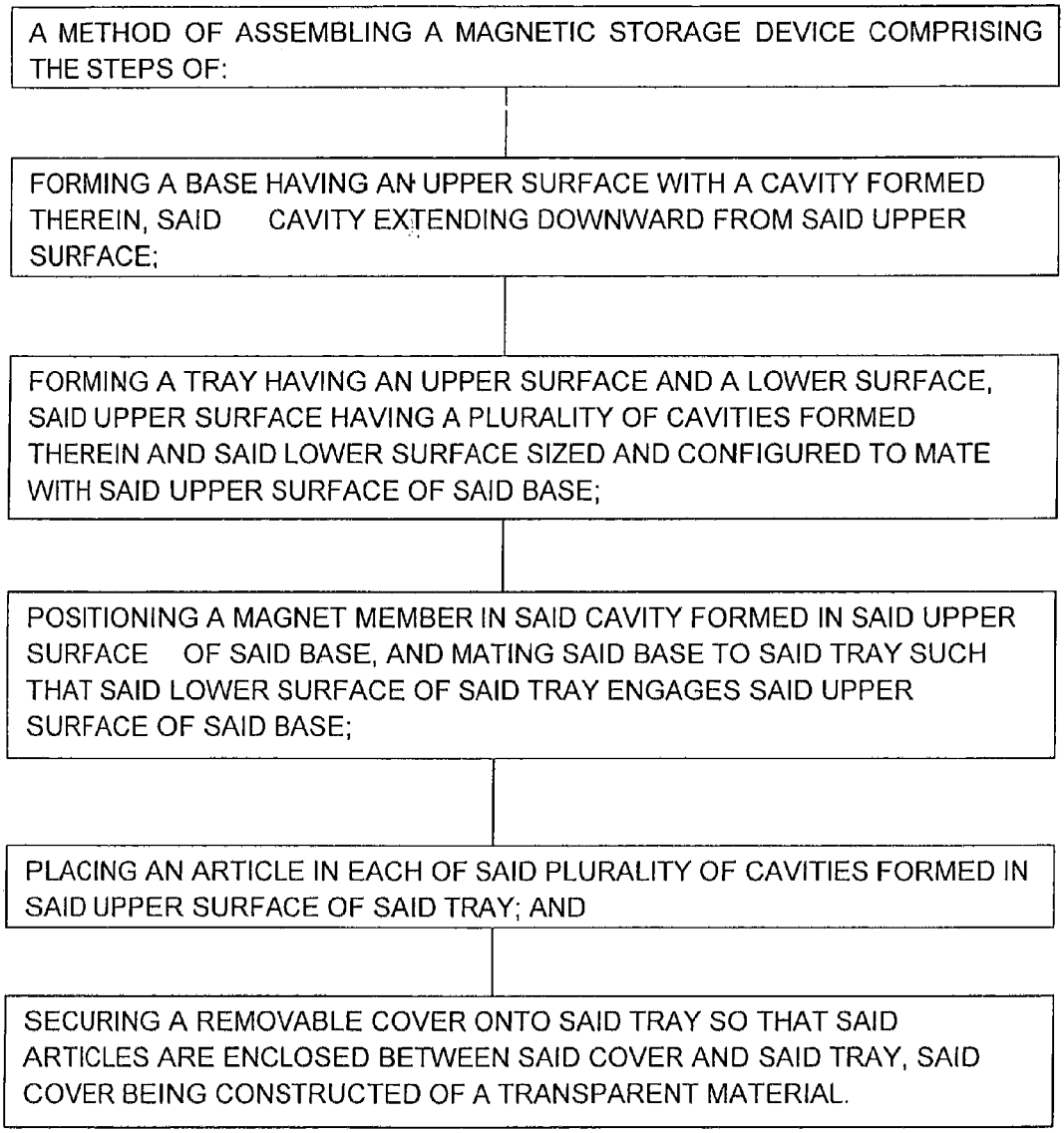
FIG. 12 is a flow diagram showing a method of assembling a magnetic storage device.

With reference to FIG. 12, a method of assembling a magnetic storage device 10" which is capable of retaining a plurality of articles 12, each having a thickness and a magnetic affinity, will now be explained. The method of assembling a magnetic storage device 10" includes the steps of forming a base 56. The base 56 has an upper surface 58 with a cavity 60 formed in the upper surface 58. The cavity 60 extends downward from the upper surface 58. The method also includes forming a tray 40 having an upper surface 42, a lower surface 44 and a height h therebetween. The lower surface 44 is sized and configured to mate with the upper surface 58 of the base 56. The upper surface 42 of the tray 40 has a plurality of cavities 46 formed therein. Each of the plurality of cavities 46 has an elongated, semi-circular configuration with opposite ends. A pair of raised abutments 48, 48 is aligned adjacent to the opposite ends of each of the plurality of cavities 46. Each of the pair of raised abutments 48, 48 has an upper surface 50 which is located below the upper surface 42 of the tray 40. Each of the upper surfaces 50, 50 of the pair of abutments 48, 48 extends upward to a height that is less than the thickness of one of the plurality of articles 12 when at least one of the plurality of articles 12 is positioned in one of the plurality of cavities 46. The method further includes positioning a magnetic member 62 in the cavity 60 formed in the upper surface 58 of the base 56. The base 56 is then mated with the tray 40 such that the lower surface 44 of the tray 40 engages the upper surface 58 of the base 56. An article 12 is placed or positioned in each of the plurality of cavities 46 formed in the upper surface 42 of the tray 40.

In addition, the method can further include securing a removable cover 64 onto the tray 40 so that the articles 12 are enclosed between the cover 64 and the tray 40. The cover 64 is preferably constructed from a transparent material, such as plastic, so that one can see through the cover 64 and identify the articles 12 positioned on the tray 40.

A flange 52, 63, 76 can be formed on each of the tray 40, the base 56 and the cover 64, respectively. In addition, a first attachment mechanism 82 can be formed on the flange 63 of the base 56 and a second attachment mechanism 84 can be formed on the flange 52 of the tray 40. The first and second attachment mechanisms, 82 and 84 respectively, are capable of securing the tray 40 to the base 56. In addition, the second attachment mechanism 84 provides a means for securing a second magnetic storage device 10" to the magnetic storage device 10".

The method can further include securing a third magnetic storage device 10" to the second magnetic storage device 10" or securing the third magnetic storage device 10" to the initial magnetic storage device 10". Furthermore, the method can also include securing a fourth magnetic storage device 10" to one of the other second magnetic storage devices 10". Multiple magnetic storage devices 10", 10", etc. can be grouped or attached in this manner.

Lastly, the method can further include forming or attaching a printable surface 78 onto the flange 76 of the cover 64. The printable surface 78 can be in the form of an adhesive backed paper 78. The adhesive side is to secure the paper to the flange 76. The printable surface 78 should allow one to write, print, type, etc. one or more words, numbers, symbols, photos, images, etc. thereon. The information presented on the printable surface 78 can relate to the plurality of batteries 38 retained in the magnetic storage device 10".

While the invention has been described in conjunction with several specific embodiments, it is to be understood that many alternatives, modifications and variations will be apparent to those skilled in the art in light of the foregoing description. Accordingly, this invention is intended to embrace all such alternatives, modifications and variations which fall within the spirit and scope of the appended claims.

The invention claimed is:

1. A magnetic storage device comprising:

a) a base having an upper surface and a cavity formed in said upper surface;

b) a plurality of articles, each article having a thickness and a magnetic affinity;

c) a tray having an upper surface, a lower surface and a height therebetween, said lower surface being sized and configured to mate with said upper surface of said base, said tray having a plurality of cavities formed in said upper surface, each of said cavities being sized and configured to receive one of said plurality of articles, each of said cavities having an elongated, semi-circular configuration with opposite ends, a pair of raised abutments aligned adjacent to said opposite ends of each of said cavities, each of said raised abutments having an upper surface which is located below said upper surface of said tray, and each of said upper surfaces of said pair of raised abutments extending upward to a height that is less than the thickness of one of said plurality of articles when at least one of said plurality of articles is positioned in one of said cavities;

d) a magnetic member positioned within said cavity of said base, said magnetic member exerting a sufficient magnetic attraction on said plurality of articles when each is positioned in one of said cavities to temporarily retain said plurality of articles therein, and said magnetic member exerting a sufficient magnetic attraction through said base to releasably attach said magnetic storage device to a magnetically attractive surface; and e) a cover having an upper surface, a lower surface, and a hollow cavity which is open to said lower surface of said cover, and said hollow cavity being sized and configured to fit over said tray.

2. The magnetic storage device of claim 1 wherein each of said base and said tray has an outwardly extending flange, a first attachment mechanism is formed on said flange of said base and a second attachment mechanism is formed on said flange of said tray, and said first and second attachment mechanisms are sized and configured to engage one another and secure said base to said tray.

3. The magnetic storage device of claim 2 wherein said first attachment mechanism is a hollow, upwardly extending protrusion having a closed top surface and an open bottom surface.

4. The magnetic storage device of claim 3 wherein second attachment mechanism is a hollow, upwardly extending protrusion having a closed top surface and an open bottom surface, and said upwardly extending protrusion of said first attachment mechanism is sized and configured to nest with said open bottom surface of said second attachment mechanism.

5. The magnetic storage device of claim 4 wherein a friction fit is established when said first and second attachment mechanisms are nested together.

6. The magnetic storage device of claim 1 wherein said cover includes an outwardly extending flange and said flange has an adhesive backed paper secured to it, and said paper can be printed on.

7. The magnetic storage device of claim 1 wherein said magnetic member is a flexible magnet secured to said tray by a silicone adhesive.

8. The magnetic storage device of claim 1 wherein said lower surface of said tray contains a recess which surrounds said magnetic member and said base is secured to said tray.

9. The magnetic storage device of claim 1 wherein each of said plurality of cavities formed in said upper surface of said tray can retain less than about 50% of the thickness of each of said plurality of articles positioned therein.

10. A magnetic storage device comprising:

a) a base having an upper surface and a cavity formed in said upper surface, and said upper surface including a flange;

b) a plurality of articles, each article having a thickness and a magnetic affinity;

c) a tray having an upper surface, a lower surface and a height therebetween, said tray including a flange, said lower surface being sized and configured to mate with said upper surface of said base, said tray having a plurality of cavities formed in said upper surface, each of said cavities being sized and configured to receive one of said plurality of articles, each of said cavities having an elongated, semi-circular configuration with opposite ends, a pair of raised abutments aligned adjacent to said opposite ends of each of said cavities, each of said raised abutments having an upper surface which is located below said upper surface of said tray, and each of said upper surfaces of said pair of raised abutments extending upward to a height that is less than the thickness of one of said plurality of articles when at least one of said plurality of articles is positioned in one of said cavities;

d) a magnetic member positioned within said cavity of said base, said magnetic member exerting a sufficient magnetic attraction on said plurality of articles when each is positioned in one of said cavities to temporarily retain said plurality of articles therein, and said magnetic member exerting a sufficient magnetic attraction through said base to releasably attach said magnetic storage device to a magnetically attractive surface;

e) a cover having an upper surface, a lower surface, and a hollow cavity which is open to said lower surface of said cover, and said hollow cavity being sized and configured to fit over said tray; and f) a first attachment mechanism formed on said flange of said base and a second attachment mechanism formed on said flange of said tray, and said first and second attachment mechanisms capable of nesting one with the other to secure said base to said tray and said second attachment mechanism provides a means for securing a second magnetic storage device to said magnetic storage device.

11. The magnetic storage device of claim 10 wherein each of said plurality of cavities formed in said upper surface of said tray can retain less than about 40% of the thickness of each of said plurality of articles positioned therein.

12. The magnetic storage device of claim 10 wherein each of said plurality of cavities formed in said upper surface of said tray can retain less than about 30% of the thickness of each of said plurality of articles positioned therein.

13. The magnetic storage device of claim 10 wherein said magnetic storage device has a longitudinal axis and said cavity formed in said base is an elongated opening that extends downwardly from said upper surface of said base, and said cavity has a longitudinal axis which is aligned parallel to the longitudinal axis of said magnetic storage device.

14. The magnetic storage device of claim 10 wherein said cover is constructed from a transparent plastic.

* * * * *